US006418772B1

(12) United States Patent
Talbott et al.

(10) Patent No.: US 6,418,772 B1
(45) Date of Patent: Jul. 16, 2002

(54) CENTERING DEVICE AND METHOD FOR U-BOLT BENDING MACHINE

(75) Inventors: Larry Talbott, Cincinnati, OH (US); Kenneth Webber, Rosemére (CA)

(73) Assignees: Consolidated Metal Products, Inc., Cincinnati, OH (US); VicRoc inc., Victoriaville (CA)

( * ) Notice: Subject to any disclaimer, the term of this patent is extended or adjusted under 35 U.S.C. 154(b) by 13 days.

(21) Appl. No.: 09/658,810

(22) Filed: Sep. 11, 2000

(51) Int. Cl.[7] ..... B21J 13/10

(52) U.S. Cl. ..... 72/420; 72/213; 72/389.1; 72/428

(58) Field of Search ..... 72/213, 389.1, 72/420, 428, 212, 214

(56) References Cited

U.S. PATENT DOCUMENTS

| | | | | |
|---|---|---|---|---|
| 201,607 A | | 3/1878 | Harty | |
| 941,700 A | | 11/1909 | Donner | |
| 1,794,691 A | | 3/1931 | Houser | |
| 1,839,251 A | | 1/1932 | Norton | |
| 1,938,915 A | | 12/1933 | Leighton | |
| 2,259,700 A | | 10/1941 | Leckrone | |
| 2,647,552 A | | 8/1953 | Magnuson et al. | |
| 2,918,101 A | | 12/1959 | Riker | |
| 3,009,508 A | | 11/1961 | Kelley | |
| 3,709,024 A | * | 1/1973 | Grimoldi | 72/420 |
| 3,786,666 A | * | 1/1974 | York, Jr. | 72/420 |
| 3,803,899 A | | 4/1974 | Hertl et al. | |
| 3,918,286 A | | 11/1975 | Whitehead | |
| 4,654,912 A | | 4/1987 | Gray | |
| 4,748,707 A | | 6/1988 | Gray | |
| 4,763,506 A | * | 8/1988 | Zeng | 72/420 |
| 4,835,805 A | | 6/1989 | Gray | |
| 4,936,131 A | | 6/1990 | Gray | |
| 5,253,502 A | | 10/1993 | Poletti | |
| 5,461,897 A | | 10/1995 | Gray et al. | |
| 5,551,271 A | | 9/1996 | Gray et al. | |

* cited by examiner

*Primary Examiner*—Ed Tolan
(74) *Attorney, Agent, or Firm*—Wood, Herron & Evans, LLP

(57) ABSTRACT

A straight rod is automatically positioned at the center of a mandrel of a U-bolt bending machine for subsequent bending into a U-bolt by the bending machine. The rod is positioned between spaced centering plates of a centering device mounted to the machine. The centering plates are coupled to a transport mechanism of the centering device that automatically provides for conjoint oppositely directed movement of the centering plates to automatically center and position the centerline of the rod at the centerline of the machine without marking or measuring the rod or other tasks previously required to accurately position the rod.

21 Claims, 3 Drawing Sheets

CENTERING DEVICE AND METHOD FOR U-BOLT BENDING MACHINE

BACKGROUND OF THE INVENTION

This invention relates generally to machines and methods for bending blanks of straight rods into U-bolts and, more particularly, a device and method for centering the rod on the U-bolt bending machine prior to bending.

In the manufacture of large steel U-bolts of the type typically used to secure a semi-trailer body to a wheel supported frame or a leaf spring to a wheel supported axle, a long steel cylindrical rod is used. Commonly, the rod has a diameter of between ⅜ inch and 1 ½ inches. Threads are then formed or cut onto the opposite ends of the rod. The threaded straight rods are then successively inserted into a hydraulically or power operated bending machine which bends or cold forms each rod around a mandrel to produce a U-shaped bolt.

A properly formed U-bolt has a pair of legs which are of equal length. Otherwise, U-bolts which are formed with one leg longer than the other frequently cannot be used and must be scrapped since the bolts cannot be re-straightened and reformed. Therefore, it is important to accurately position the straight rod in the U-bolt bending machine on the mandrel so that the rod is bent into a U-bolt having equal length legs. One known method of centering or positioning a rod within the bending machine is for an operator to use a tape measure to position the rod so that the mid point of the rod is aligned with the center of the mandrel. This measuring operation requires significant time, it requires the operator to accurately measure and determine the centerline of the rod, mark the centerline and accurately align the rod centerline with the centerline of the mandrel.

Some U-bolt bending machines are equipped with a selectively positioned stop which is fixed at a selected position and used for locating one end of each rod to position the rod properly with its centerline aligned with the centerline of the mandrel. However, when rods of different lengths are successively formed into U-bolts, the position of the end stop must be adjusted according to the length of each rod. Often, the end stop must be frequently adjusted since rods are commonly bent in sets of two or four rods and each set may have a different length. Commonly, a machine operator makes an inaccurate measurement of the length of the rod or an incorrect adjustment of the end stop resulting in a number of straight rods which are formed into U-bolts without equal length legs because the centerline of the rods is not aligned precisely with the centerline of the mandrel on the U-bolt bending machine.

Another prior art approach to centering rods in a U-bolt bending machine is disclosed in U.S. Pat. No. 4,936,131. The invention disclosed in that patent includes permanently marking each rod to indicate the longitudinal center point of the rod. Specifically, the center point of the rod is marked by a stripe of ink directly on the rod or on a label attached to the rod to provide a permanent mark which does not require rotating the rod to find the centerline. The marked centerline is then aligned with a mark located on the center of the machine prior to bending the rod into a U-bolt. However, this system of centering a rod in a U-bolt bending machine has drawbacks. Specifically, the requirement that each rod must be marked or labeled with the centerline. This increases the cost of each rod. Further, a particular operator of a U-bolt bending machine has a limited number of suppliers for rod stock, specifically, those suppliers which offer rods with the centerline indicator thereon.

Moreover, the operator of the U-bolt bending machine still must visually align the centerline of the rod with the centerline of the machine or mandrel for each an every U-bolt being produced. Additionally, to effectively and permanently mark the steel rods, machine oil or other coatings on the steel rod must be effectively removed to apply the tape or marking paint thereto. As such, the rods require additional processing steps and are subsequently more susceptible to corrosion and rust as a result of the removal of these coatings.

SUMMARY OF THE INVENTION

Therefore, there is a need for an efficient and effective method and system for centering rods on U-bolt bending machines to consistently produce U-bolts having equal length legs that overcome the above-described shortcomings of known techniques. This invention satisfies these and other objectives while providing a more efficient and economical method of producing U-bolts to substantially reduce the scrap rate of incorrectly formed or bent U-bolts and significantly reducing the bending time. Further, the invention eliminates the need for the supplier, operator or anyone to measure each rod before bending it into a U-bolt, the operator to adjust fixed end stops for various lengths of rod or visually align the centerline mark on the rod with the centerline of the machine.

In a presently preferred embodiment of this invention, a U-bolt bending machine centering device and associated method automatically and accurately positions each rod relative to the mandrel or centerline of the bending machine for accurate, efficient and consistent bending of U-bolts. The centering device is mounted to a standard U-bolt bending machine and includes an elongate carriage fixed to the machine near the mandrel around which the metal rod is bent into a U-shaped bolt. The carriage has a pair of centering plates mounted thereto for conjoint movement in opposite directions toward and away from the mandrel. Each centering plate is coupled to a transport mechanism through a mounting assembly. The transport mechanism in one embodiment includes a pair of elongate rack gears each having a plurality of teeth. The rack gears are contained within slots in the carriage and are vertically spaced one from another. Each rack gear meshes with a pinion gear that is aligned relative to the centerline of the machine or the mandrel around which the rod will be bent.

As a result of the transport mechanism, movement of one centering plane toward or away from the mandrel results in an equal and oppositely directed movement of the other centering plate. Therefore, the straight rod to be formed into a U-bolt can simply be placed on the mandrel in any location between the centering plates. The user manually moves one of the centering plates into contact with the corresponding threaded end of the rod until the opposite end of the rod likewise contacts the opposite centering plate. The movement of the centering plates automatically slides or positions the rod on the mandrel thereby providing a reliable and consistent positioning of the rod in the U-bolt bending machine without the need for marking, measuring or visually aligning the rod.

The mounting assembly for each centering plate includes a pivot pin about which the centering plate can be pivoted downwardly in a direction perpendicular to the orientation of the rod on the mandrel. This provides better access to the carriage or other components of the U-bolt bending machine and avoids interference with the centering plates when they are not needed or in use.

BRIEF DESCRIPTION OF THE DRAWINGS

The objectives and features of the invention will become more readily apparent from the following detailed description taken in conjunction with the accompanying drawings in which.

DETAILED DESCRIPTION OF THE DRAWINGS

Figure 1:
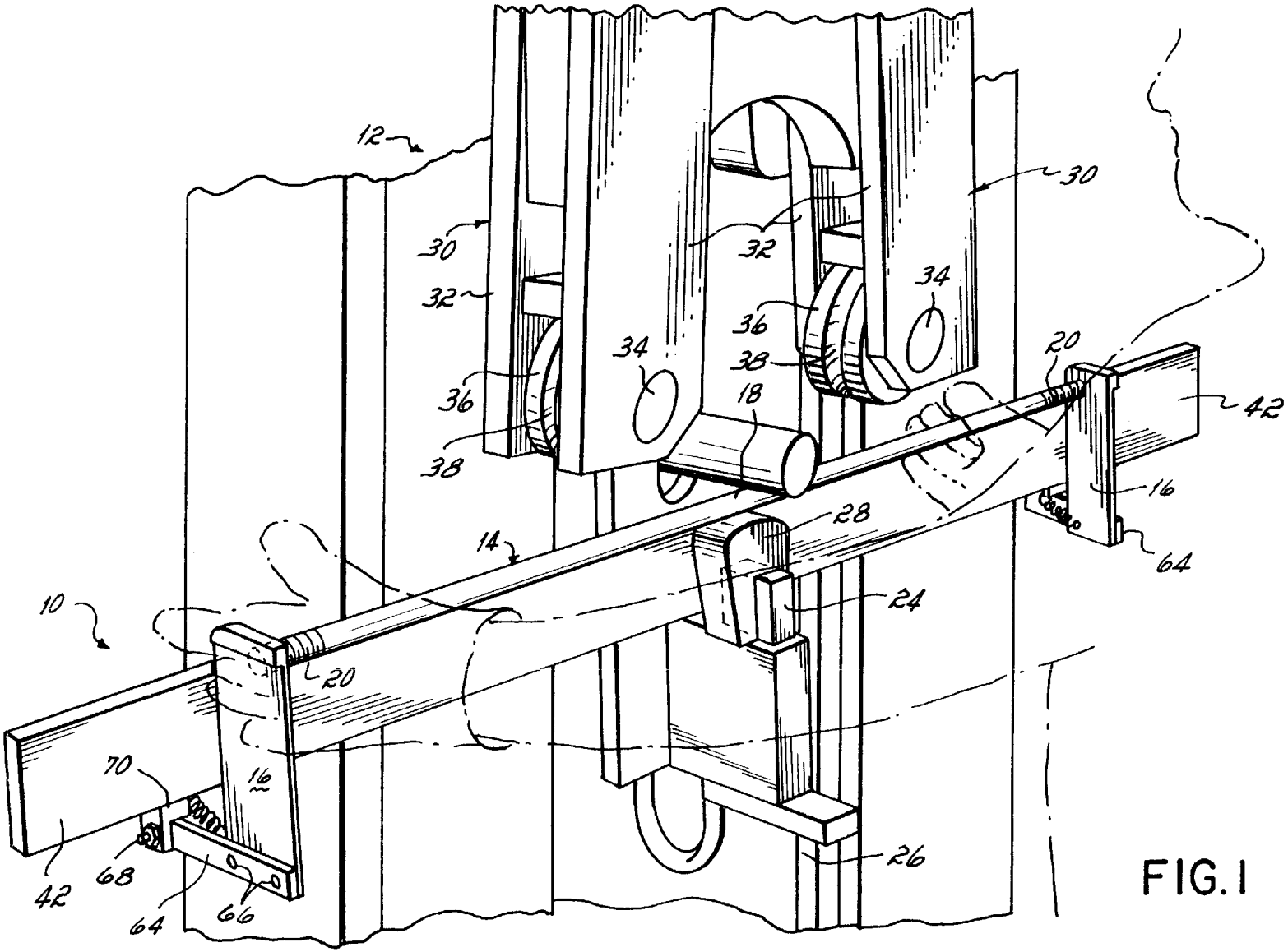
FIG. 1 is a perspective view of a presently preferred embodiment of a centering device mounted on a U-bolt bending machine according to this invention.

Referring to FIG. 1, a presently preferred embodiment of a centering device 10 for a U-bolt bending machine 12 is shown. The centering device 10 is adapted to be mounted to the U-bolt bending machine 12 either as original equipment or as a retrofit item to be incorporated into the bending machine 12. A cylindrical metal or steel rod 14 is positioned in the centering device 10 between a pair of spaced centering plates 16. The rod 14 has a center portion 18 positioned between spaced threaded ends 20. The threaded metal rods 14 are commonly manufactured in a wide range of diameters, for example, from ⅜ inch to 1 ½ inches and in different steel compositions according to the uses or applications of the rods 14 after they are bent or cold formed into U-bolts 22.

The U-bolt bending machine 12 includes a generally vertically oriented post 24 mounted to a support frame 26 on the front side of the machine 12. The post 24 receives an inverted U-shaped mandrel or forming die 28 which slides downwardly onto the post 24. The mandrel 28 is interchangeable with other dies or mandrels of different shapes and different widths and may be replaced simply by lifting the mandrel 28 from the post 24.

The upper portion of the mandrel 28 is adapted to receive and support the central portion 18 of the metal rod 14. The U-bolt bending machine 12 includes a pair of bending arms 30 which have upper end portions (not shown) pivotally connected to the frame 26. Each of the arms 30 is formed by a pair of parallel spaced plates 32. A shaft 34 extends between each pair of spaced plates 32 at a lower end thereof and a bending roller 36 having a peripherally extending groove 38 is mounted for rotation on each of the shafts 34.

As is well known from standard U-bolt bending machines 12, after a threaded rod 14 is positioned on the mandrel 28, the hydraulically driven bending arms 30 move downwardly so that the bending rollers 36 bend the rod 14 around the mandrel 28. Typically, the bending rollers 36 have converging and slightly non-linear paths as they move downwardly to bend the rod 14 around the mandrel 28 into a U-bolt 22. Optimally, the rod 14 is centered on the mandrel so that the resulting U-bolt 22 has equal length legs 40 (FIG. 4D) that are preferably parallel with one another. A U-bolt bending machine 12, which is compatible with this invention, is commercially available from Vic Roc, Inc. of Quebec, Canada as model UB-302 or UB-502 U-Bolt Bender.

Figure 2:
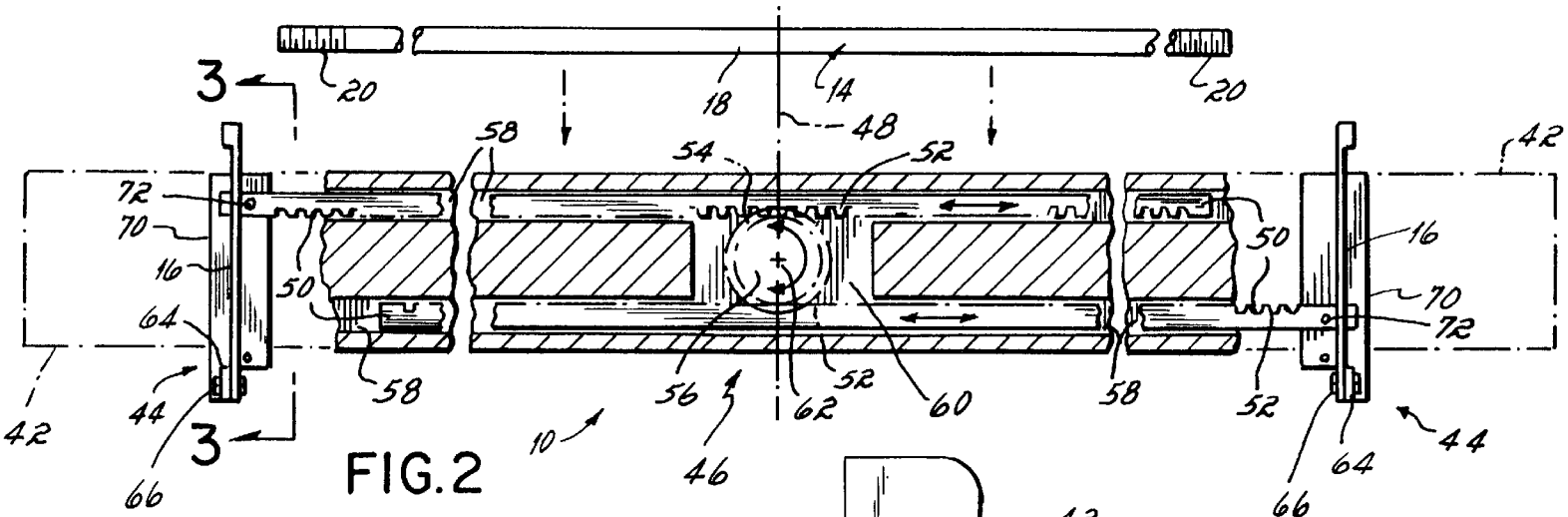
FIG. 2 is a front elevational view of the centering device and steel rod inserted therein according to FIG. 1.

Referring to FIGS. 1 and 2, the centering device 10 is mounted to the U-bolt bending machine frame 26 proximate the mandrel 28. The centering device 10 includes an elongate carriage 42 to which each of the centering plates 16 are mounted by a mounting assembly 44. The centering plates 16 are mounted to the carriage 42 for sliding generally linear movement toward and away from the mandrel 28. Movement of the centering plates 16 is controlled by a transport mechanism 46 which provides for a conjoint movement of the centering plates 16 in opposite directions so that movement of one centering plate 16 automatically results in an equal distance movement by the other centering plate 16 in the opposite direction. The centering device 10 is mounted to the U-bolt bending machine 12 such that the centering plates 16 are equally spaced from a centerline 48 of the mandrel.

In one presently preferred embodiment, the transport mechanism 46 includes a pair of spaced generally parallel rack gears 50, each having a number of teeth 52 that mesh with teeth 54 on a rotating pinion gear 56 centrally located between the spaced rack gears as shown particularly in FIG. 2. Each rack gear 50 is connected to one of the centering plates 16 and the rack gears 50 each slide or translate within a slot 58 in the carriage 42. The pinion gear 56 is mounted for rotation in a cavity 60 in the carriage 42 for rotation in either a clockwise or counterclockwise direction, depending on which direction the rack gears 50 are sliding or translating to provide for the movement of the centering plates toward and/or away from the mandrel 28.

Preferably, the center of rotation 62 of the pinion gear 56 is aligned with the centerline of the mandrel 48; however, this is not critical to the operation of the invention. Nevertheless, it is important that the centering plates 16 be spaced an equal distance on either side of the centerline 48 of the mandrel 28 although the pinion gear 56 may be off-set from the centerline 48 of the mandrel 28.

While a presently preferred embodiment of the transport mechanism 46 is shown and described herein with the pair of rack gears 50 and meshing pinion gear 56, it should be readily appreciated that other transport mechanism designs can be utilized within the scope of this invention. For example, a system of cables, pulleys and/or drums could be utilized for the conjoint movement in opposite directions of the centering plates 16. Similarly, an acme screw or other threaded member likewise could be utilized for the transport mechanism. Other configurations and designs may also be employed within the scope of this invention to provide the conjoint movement of the centering plates 16 in equal amounts but opposite directions relative to the mandrel 28.

Figure 3:
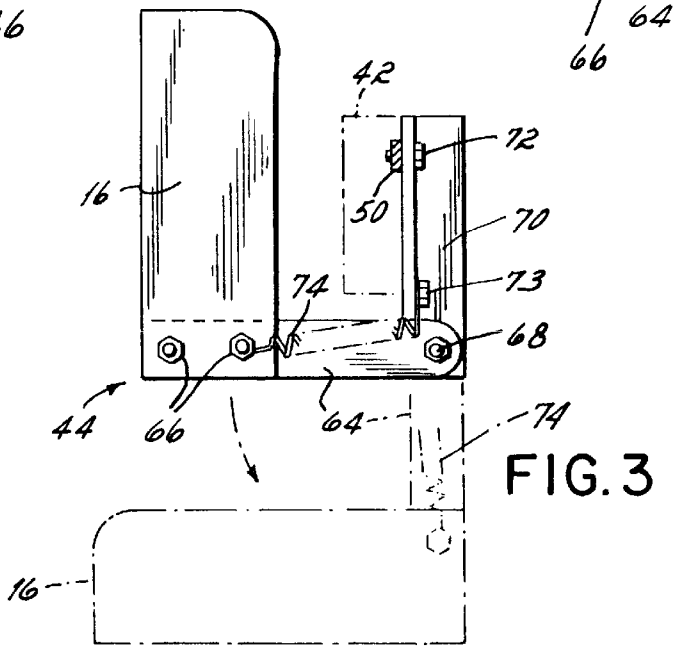
FIG. 3 is a side-elevational view of a mounting assembly for a centering plate of the centering device as seen on line 3—3 of FIG. 2.

Referring particularly to FIG. 3, the mounting assembling 44 for each of the centering plates 16 is shown. Each centering plate 16 is secured to the outer end of a mounting arm 64 by a pair of spaced bolts or other fasteners 66. An inner end of the mounting arm 64 is attached to a pivot pin 68 projecting from the lower end of an L-shaped mounting flange 70. The mounting flange 70 is secured by a bolt or other fastener 72 to one of the rack gears 50. The pivotal mounting of the centering plate 16 and mounting arm 64 to the carriage 42 via the mounting flange 70 provides for pivotal movement of the centering plate 16 in a plane generally perpendicular to the carriage 42 or orientation of the rod 14 placed on the mandrel 28 between the centering plates 16. Preferably, the centering plate 16 is biased by a spring 74 toward an operational position to contact one of the ends 20 of the rod 14 as shown in FIGS. 1 and 2. Alternatively, the centering plate 16 may be pivoted downwardly away from the operational position toward a stowed position as shown in phantom in FIG. 3. The spring 74 is secured between the fastener 73 on the flange and one of the fasteners 66 connecting the centering plate 16 to the mounting arm 64 as shown in FIG. 3.

Referring generally to FIGS. 1 and 4, the operation of the centering device 10 will be described as follows. The centering plates 16 are manually separated a sufficient distance for the rod 14 to be placed therebetween and supported on the mandrel 28 as shown in FIG. 1. Importantly, precise positioning of the rod 14 is not initially a concern because the centerline 76 of the rod 14 will be aligned with the centerline 48 of the mandrel 28 automatically through the implementation of the centering device 10.

Figure 4A:
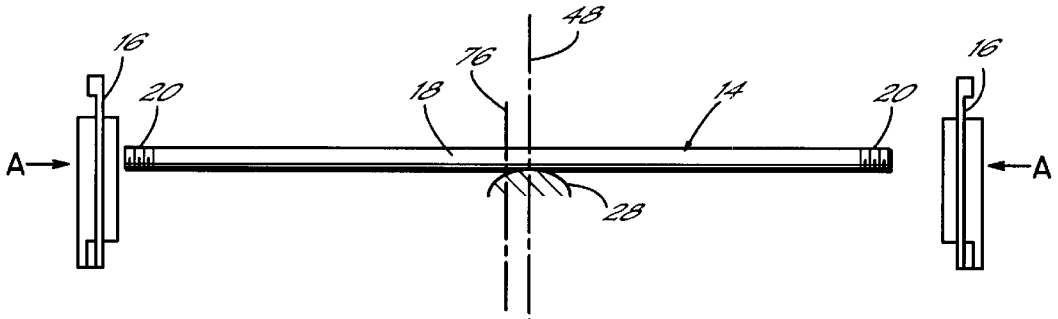
FIGS. 4A–4D are sequential schematic views of the centering plates centering a rod on a mandrel for subsequent bending into a U-bolt according to this invention.
Figure 4B:
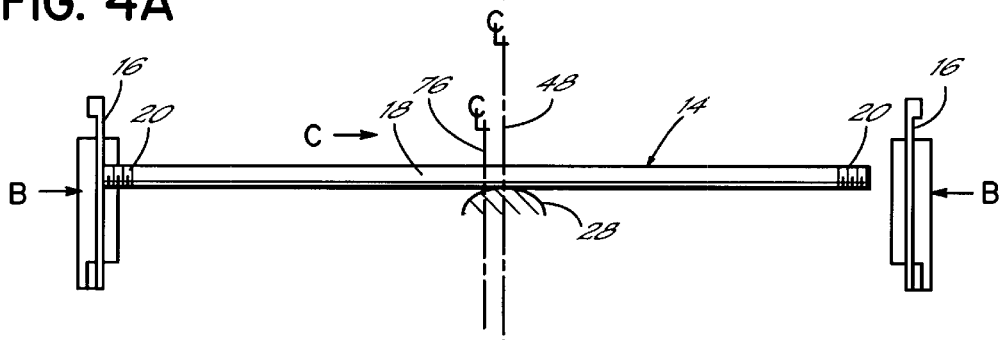
Figure 4C:
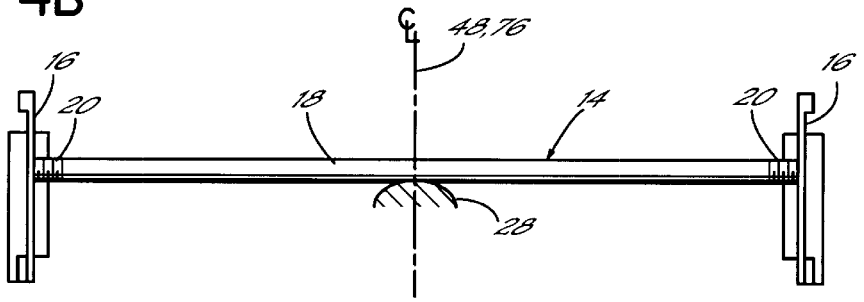
Figure 4D:
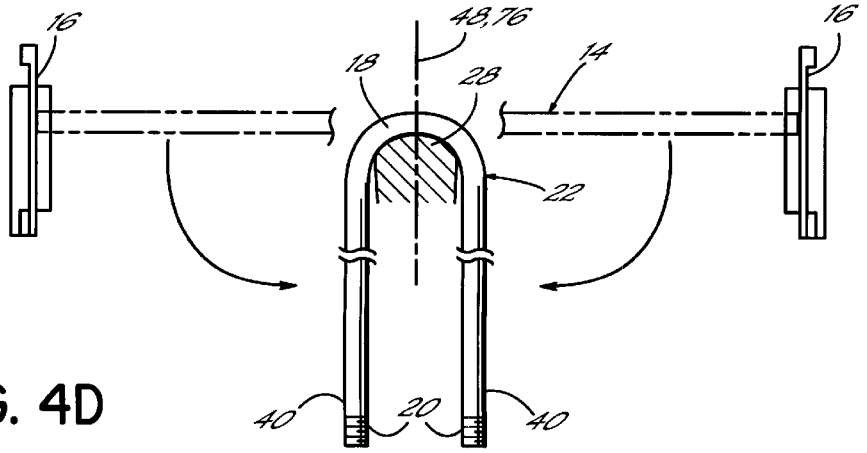

Referring to FIG. 4A, the centerline 76 of the rod 14 is initially spaced from the centerline 48 of the mandrel 28 when the rod 14 is placed on and supported by the mandrel 28. Subsequently, an operator slides one or both of the centering plates 16 inwardly (Arrow A) until one of the centering plates 16 contacts the corresponding end 20 of the rod 14. The movement of one of the centering plates 16 automatically results in an equal and oppositely directed movement of the other centering plate 16 so that both centering plates 16 are always an equal distance from the centerline 48 of the mandrel 28. After one of the centering plates 16 initially contacts the corresponding end 20 of the rod 14, the operator continues to slide the centering plates 16 toward (Arrow B) the centerline 48 of the mandrel 28 thereby resulting in conjoint and equal distance movement of both centering plates 16. The rod 14 slides (Arrow C) on the mandrel 28 toward the centering plate 16 that has not yet contacted the rod 14 (i.e., to the right as shown by arrow C in FIG. 4B). The operator continues to push one or both of the centering plates 16 inwardly toward the mandrel 28 until each centering plate 16 is in contact with the corresponding end 20 of the rod 14. The sliding movement of the rod 14 on the mandrel 28 draws the centerlines 48, 76 of the mandrel 28 and rod 14 closer together until they are co-linearly aligned as shown in FIG. 4C. As a result, the rod 14 is automatically centered on the mandrel 28 for subsequent bending into a U-bolt 22 having equal length legs 40 as shown in FIG. 4D.

Therefore, as a result of the centering device 10 and operation thereof according to this invention, a generally linear rod 14 is automatically positioned with its centerline 76 aligned with the centerline 48 of the mandrel 28 on the U-bolt bending machine 12 without the need for measurement, visual alignment by the operator, marking of the centerline 76 of the rod 14 or the like. In fact, the operator does not need to determine, mark, detect or otherwise be concerned with the actual position of the centerline 76 of the rod 14 or of the centerline 48 of the mandrel 28 once the centering device 10 is appropriately calibrated and positioned on the machine 12. As a result of this invention, the rod 14 is automatically centered relative to the mandrel 28 and the machine 12 for subsequent U-bolt bending. Moreover, a variety of lengths of rods 14 can be bent on the U-bolt bending machine 12 and automatically centered prior to bending without measuring, recalibration or adjustment of the centering device 10.

From the above disclosure of the general principles of the present invention and the preceding detailed description of at least one preferred embodiment, those skilled in the art will readily comprehend the various modifications to which this invention is susceptible. Therefore, we desire to be limited only by the scope of the following claims and equivalents thereof.

What is claimed is:

1. A U-bolt bending machine centering device to center a rod having threaded spaced ends to be bent around a mandrel on the U-bolt bending machine into a U-bolt, the centering device comprising:

an elongate carriage adapted to be mounted to the U-bolt bending machine;

a pair of spaced centering plates coupled to the carriage and equally spaced on opposite sides of the mandrel when the carriage is mounted to the U-bolt bending machine; and a transport mechanism on the carriage and coupled to each of the centering plates to provide conjoint movement of the centering plates in opposite directions relative to the mandrel when the carriage is mounted to the U-bolt bending machine;

wherein when a rod is placed on the mandrel between the centering plates with the centering device mounted to the U-bolt bending machine, one of the centering plates is moved in a first direction into contact with one of the ends of the rod until the other end of the rod contacts the other centering plate thereby centering the rod on the mandrel for subsequent bending by the U-bolt bending machine into a U-bolt having generally equal length legs.

2. The U-bolt bending machine centering device of claim 1 wherein the transport mechanism further comprises:

a pair of rack gears each of which has a plurality of teeth and is coupled to one of the centering plates for movement on the carriage; and a pinion gear having a plurality of teeth and meshing with the teeth on each of the rack gears.

3. The U-bolt bending machine centering device of claim 2 wherein the rack gears are generally parallel to each other with the pinion gear therebetween and generally aligned with the mandrel.

4. A U-bolt bending machine centering device to center a rod having threaded spaced ends to be bent around a mandrel on the U-bolt bending machine into a U-bolt, the centering device comprising:

an elongate carriage adapted to be mounted to the U-bolt bending machine;

a pair of spaced centering plates coupled to the carriage and equally spaced on opposite sides of the mandrel when the carriage is mounted to the U-bolt bending machine;

a transport mechanism on the carriage and coupled to each of the centering plates to provide conjoint movement of the centering plates in opposite directions relative to the mandrel when the carriage is mounted to the U-bolt bending machine; and a mounting assembly coupling each of the centering plates to the transport mechanism, each mounting assembly including a mounting arm extending from the centering plate and being pivotally coupled to the transport mechanism to permit pivotal movement of the centering plate in a plane perpendicular to the first direction;

wherein when a rod is placed on the mandrel between the centering plates with the centering device mounted to the U-bolt bending machine, one of the centering plates is moved in a first direction into contact with one of the ends of the rod until the other end of the rod contacts the other centering plate thereby centering the rod on the mandrel for subsequent bending by the U-bolt bending machine into a U-bolt having generally equal length legs.

5. The U-bolt bending machine centering device of claim 4 wherein each centering plate is biased toward an operational position for engagement with one of the ends of the rod.

6. A U-bolt bending machine centering device to center a rod having threaded spaced ends to be bent around a mandrel on the U-bolt bending machine into a U-bolt, the centering device comprising:

an elongate carriage adapted to be mounted to the U-bolt bending machine, the carriage having upper and lower generally parallel slots formed therein and a central cavity positioned between the upper and lower slots;

a pair of spaced centering plates coupled to the carriage and equally spaced on opposite sides of the mandrel when the carriage is mounted to the U-bolt bending machine; and a pair of rack gears each of which has a plurality of teeth and is coupled to one of the centering plates for movement on the carriage in one of the slots;

a pinion gear having a plurality of teeth and meshing with the teeth on each of the rack gears, the pinion gear being positioned in the cavity in the carriage and cooperating with the rack gears to provide conjoint movement of the centering plates in opposite directions relative to the mandrel when the carriage is mounted to the U-bolt bending machine;

wherein when a rod is placed on the mandrel between the centering plates with the centering device mounted to the U-bolt bending machine, one of the centering plates is moved in a first direction into contact with one of the ends of the rod until the other end of the rod contacts the other centering plate thereby centering the rod on the mandrel for subsequent bending by the U-bolt bending machine into a U-bolt having generally equal length legs; and a mounting assembly coupling each of the centering plates to the respective rack gear, each mounting assembly including a mounting arm extending from the centering plate and being pivotally coupled to the respective rack gear to permit pivotal movement of the centering plate in a plane perpendicular to the first direction, wherein the mounting assembly biases each centering plate toward an operational position for engagement with one of the ends of the rod.

7. A system for bending a generally straight rod having threaded spaced ends into a U-bolt comprising:

a machine frame;

a mandrel mounted on the machine frame and adapted to support the rod;

a pair of bending arms positioned on opposite sides of the mandrel, each bending arm having a bending roller mounted thereon, the bending arms being selectively driven for movement relative to the mandrel to engage the rod supported thereon with the bending rollers and thereby bend the rod into a U-shape around the mandrel;

an elongate carriage mounted to the machine frame;

a pair of spaced centering plates coupled to the carriage and equally spaced on opposite sides of the mandrel; and a transport mechanism on the carriage and coupled to each of the centering plates to provide conjoint movement of the centering plates in opposite directions relative to the mandrel;

wherein when the generally straight rod is placed on the mandrel between the centering plates, one of the centering plates is moved in a first direction into contact with one of the ends of the rod until the other end of the rod contacts the other centering plate thereby centering the rod on the mandrel for subsequent bending around the mandrel to form the U-bolt with generally equal length legs.

8. The system of claim 7 wherein the transport mechanism further comprises:

a pair of rack gears each of which has a plurality of teeth and is coupled to one of the centering plates for movement on the carriage; and a pinion gear having a plurality of teeth and meshing with the teeth on each of the rack gears.

9. The system of claim 8 wherein the rack gears are generally parallel to each other with the pinion gear therebetween and generally aligned with the mandrel.

10. A system for bending a generally straight rod having threaded spaced ends into a U-bolt comprising:

a machine frame;

a mandrel mounted on the machine frame and adapted to support the rod;

a pair of bending arms positioned on opposite sides of the mandrel, each bending arm having a bending roller mounted thereon, the bending arms being selectively driven for movement relative to the mandrel to engage the rod supported thereon with the bending rollers and thereby bend the rod into a U-shape around the mandrel;

an elongate carriage mounted to the machine frame;

a pair of spaced centering plates coupled to the carriage and equally spaced on opposite sides of the mandrel;

a transport mechanism on the carriage and coupled to each of the centering plates to provide conjoint movement of the centering plates in opposite directions relative to the mandrel; and a mounting assembly coupling each of the centering plates to the transport mechanism, each mounting assembly including a mounting arm extending from the centering plate and being pivotally coupled to the transport mechanism to permit pivotal movement of the centering plate in a plane perpendicular to the first direction;

wherein when the generally straight rod is placed on the mandrel between the centering plates, one of the centering plates is moved in a first direction into contact with one of the ends of the rod until the other end of the rod contacts the other centering plate thereby centering the rod on the mandrel for subsequent bending around the mandrel to form the U-bolt with generally equal length legs.

11. The system of claim 10 wherein each centering plate is biased toward an operational position for engagement with one of the ends of the rod.

12. A method for centering a generally straight rod having spaced threaded ends on a U-bolt bending machine for subsequent bending into a U-bolt, the method comprising the steps of:

spacing a pair of centering plates a distance greater than a length of the rod, each of the centering plates being coupled to a transport mechanism to provide conjoint movement of the centering plates in opposite directions relative to a mandrel mounted on the U-bolt bending machine;

positioning the rod between the centering plates; and moving one of the centering plates toward the mandrel until each of the centering plates contacts one of the ends of the rod, the moving of one of the centering plates resulting in movement of the other one of the centering plates via the transport mechanism an equal amount in an opposite direction to thereby center the rod relative to the mandrel.

13. The method of claim 12 further comprising:

supporting the rod at a location between the ends on the mandrel prior to the moving step.

14. The method of claim 13 further comprising:

sliding the rod on the mandrel during the moving step.

15. The method of claim 12 wherein the moving step further comprises:

moving each of a pair of rack gears relative to the mandrel, each of the rack gears being coupled to one of the centering plates and meshing with a pinion gear to thereby provide conjoint movement of the centering plates in opposite directions.

16. The method of claim 12 wherein the moving step is accomplished manually.

17. A method for centering a generally straight rod having spaced threaded ends on a U-bolt bending machine for subsequent bending into a U-bolt, the method comprising the steps of:

spacing a pair of centering plates a distance greater than a length of the rod, each of the centering plates being coupled to a transport mechanism to provide conjoint movement of the centering plates in opposite directions relative to a mandrel mounted on the U-bolt bending machine;

positioning the rod between the centering plates;

moving one of the centering plates toward the mandrel until each of the centering plates contacts one of the ends of the rod, the moving of one of the centering plates resulting in movement of the other one of the centering plates via the transport mechanism an equal amount in an opposite direction to thereby center the rod relative to the mandrel; and pivoting each of the centering plates within a plane generally perpendicular to the rod toward an operational position for contact with one of the ends of the rod.

18. The method of claim 17 further comprising:

biasing each of the centering plates toward the operational position.

19. A method for centering a generally straight rod having spaced threaded ends on a U-bolt bending machine for subsequent bending into a U-bolt, the method comprising the steps of:

spacing a pair of centering plates a distance greater than a length of the rod, each of the centering plates being coupled to a transport mechanism to provide conjoint movement of the centering plates in opposite directions relative to a mandrel mounted on the U-bolt bending machine;

positioning the rod between the centering plates;

supporting the rod at a location between the ends on the mandrel;

pivoting each of the centering plates within a plane generally perpendicular to the rod toward an operational position for contact with one of the ends of the rod;

moving one of the centering plates toward the mandrel until each of the centering plates contacts one of the ends of the rod, the moving of one of the centering plates resulting in movement of the other one of the centering plates via the transport mechanism an equal amount in an opposite direction to thereby center the rod relative to the mandrel; and sliding the rod on the mandrel during the moving step.

20. The method of claim 19 wherein the moving step further comprises:

moving each of a pair of rack gears relative to the mandrel, each of the rack gears being coupled to one of the centering plates and meshing with a pinion gear to thereby provide conjoint movement of the centering plates in opposite directions.

21. A method of bending a generally straight rod having spaced threaded ends into a U-bolt having generally equal length legs, the method comprising the steps of:

spacing a pair of centering plates a distance greater than a length of the rod, each of the centering plates being coupled to a transport mechanism to provide conjoint movement of the centering plates in opposite directions relative to a mandrel;

positioning the rod between the centering plates;

supporting the rod on the mandrel at a location which is not equidistant between the ends;

manually moving one of the centering plates toward the mandrel until each of the centering plates contacts one of the ends of the rod, the moving of one of the centering plates resulting in movement of the other one of the centering plates via the transport mechanism an equal amount in an opposite direction to thereby center the rod relative to the mandrel;

sliding the rod on the mandrel during the moving step until the center of the rod is aligned with the mandrel;

moving a pair of bending arms spaced on opposite sides of the mandrel into contact with the rod; and bending the rod around the mandrel with continued movement of the arms relative to the mandrel.

* * * * *